US008678379B2

(12) United States Patent
Bechberger et al.

(10) Patent No.: US 8,678,379 B2
(45) Date of Patent: Mar. 25, 2014

(54) METHOD FOR FEEDING SHEETS TO A PRINTING TECHNOLOGY MACHINE

(71) Applicant: Heidelberger Druckmaschinen AG, Heidelberg (DE)

(72) Inventors: Thomas Bechberger, Östringen (DE); Holger Edinger, Weinheim (DE); Rolf Kündgen, Bad Schönborn (DE); Klaus Lulay, Bensheim (DE); Burkhard Wolf, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 13/744,628

(22) Filed: Jan. 18, 2013

(65) Prior Publication Data

US 2013/0181395 A1 Jul. 18, 2013

(30) Foreign Application Priority Data

Jan. 18, 2012 (DE) ..... 10 2012 000 918

(51) Int. Cl.
*B65H 1/22* (2006.01)

(52) U.S. Cl.
USPC ..... 271/151; 271/149; 271/216; 271/270

(58) Field of Classification Search
USPC ..... 271/149, 151, 216
See application file for complete search history.

(56) References Cited

U.S. PATENT DOCUMENTS

| | | | | | |
|---|---|---|---|---|---|
| 4,805,890 | A * | 2/1989 | Martin | ..... | 271/203 |
| 5,584,244 | A * | 12/1996 | Klingler et al. | ..... | 101/484 |
| 5,870,957 | A * | 2/1999 | Muller | ..... | 101/484 |
| 2003/0015835 | A1 * | 1/2003 | Post et al. | ..... | 271/149 |

FOREIGN PATENT DOCUMENTS

| | | | |
|---|---|---|---|
| DE | 44 07 631 | C1 | 10/1995 |
| DE | 196 39 134 | C2 | 4/1998 |
| DE | 199 16 470 | A1 | 10/2000 |
| DE | 100 22 585 | A1 | 11/2001 |
| DE | 10 2007 057 732 | A1 | 6/2009 |

OTHER PUBLICATIONS

German Patent and Trademark Office Search Report Dated Oct. 9, 2012.

* cited by examiner

*Primary Examiner* — Prasad Gokhale
(74) *Attorney, Agent, or Firm* — Laurence A. Greenberg; Werner H. Stemer; Ralph E. Locher

(57) ABSTRACT

A method for feeding sheets to a printing technology machine improves reliability of feeding sheets and reduces an acceleration time from a base speed to a production speed. The sheets are conveyed onto a feed table in shingled formation by a first drive and are individually and successively conveyed from the feed table to a first processing station of the machine by a second drive. The sheets are conveyed onto the feed table before an acceleration of the second drive to production speed is completed and the first drive is accelerated to the production speed when the processing station has reached the production speed.

5 Claims, 5 Drawing Sheets

METHOD FOR FEEDING SHEETS TO A PRINTING TECHNOLOGY MACHINE

CROSS-REFERENCE TO RELATED APPLICATION

This application claims the priority, under 35 U.S.C. §119, of German Patent Application DE 10 2012 000 918.6, filed Jan. 18, 2012; the prior application is herewith incorporated by reference in its entirety.

BACKGROUND OF THE INVENTION

Field of the Invention

The invention relates to a method for feeding sheets to a printing technology or graphic arts industry machine, which includes conveying the sheets onto a feed table in shingled formation using a first drive, conveying the sheets individually and successively from the feed table to a first processing station of the machine using a second drive and accelerating the drives starting from a base speed to a production speed.

German Patent DE 44 07 631 C1, corresponding to U.S. Pat. No. 5,584,244, discloses a method for bringing a sheet-fed printing press up to production speed. In accordance with the disclosed method, waste sheets are avoided during the acceleration by ensuring that sheets are separated from a stack and conveyed to a feed table only when a production run speed has been reached. That is done to ensure that no sheets are being printed while the sheet-fed printing press is accelerated to the production run speed. Due to the fact that the separating operation is switched on with a time delay, a relatively long period of time elapses between the moment the start-up of the printing press begins and the printing of the first sheet. The first separated sheet is conveyed onto the feed table at a high speed. That may cause thin sheets, in particular, to flutter at the corners, which may cause disruptions to the sheet-feeding operation.

In accordance with a method for bringing a printing technology machine up to production speed as disclosed in German Patent DE 196 39 134 C2, corresponding to U.S. Pat. No. 5,870,957, the amount of start-up waste is reduced in that the feeding of sheets is switched on prior to or during the acceleration of a sheet-fed printing press up to the production run speed. The switching-on instant is selected in such a way as to ensure that a first sheet does not reach a predetermined position in the machine until the production run speed has been reached. If the sheet-fed printing press is to be accelerated to a high production run speed, the instant at which the feeding of sheets is switched on is later than the beginning of the start-up operation. The first sheet that is conveyed onto a feed table has a relatively high speed. Again, there is a risk that the corners may flutter and that the feeding operation may be disrupted.

SUMMARY OF THE INVENTION

It is accordingly an object of the invention to provide a method for feeding sheets to a printing technology machine, which overcomes the hereinafore-mentioned disadvantages of the heretofore-known methods of this general type and which improves reliability of a sheet-feeding operation and shortens a period of time required to accelerate the machine from a base speed to a production speed.

With the foregoing and other objects in view there is provided, in accordance with the invention, a method for feeding sheets to a printing technology machine. The method comprises conveying the sheets in a conveying direction onto a feed table in shingled formation using a first drive, conveying the sheets individually and successively from the feed table to a first processing station of the machine using a second drive, and accelerating the drives from a base speed to a production speed as follows: conveying the sheets to the feed table before the second drive has reached the production speed, stopping the first drive as soon as the sheets on the feed table assume a predefined position in the conveying direction and are at a predefined distance from each other, and then accelerating the first drive to the production speed after the processing station has reached the production speed.

In accordance with the invention, during the acceleration of a machine to a production speed, sheets are conveyed onto a feed table in shingled or overlapping, formation preferably at a speed that is lower than the current start-up speed. It is only when a first processing station of the machine has reached production speed that the drive for loading the feed table is accelerated to its production speed. Due to separate drives for the processing stations of the machine and for a conveying device on a feed table for a first processing station, it is possible to shingle the sheets at a low speed. The corners of the thin sheets are no longer in danger of starting to flutter. When the shingling operation on the feed table is completed, the processing operation does not start until the production speed of the machine is reached. The speed at which the sheets are conveyed onto the feed table may be adjusted as a function of the thickness of the sheets. The drive for the shingling of the sheets may temporarily be stopped when the sheets are in a predefined position on the feed table in the conveying direction and are at a predefined distance from each other.

The invention may be used in all printing technology machines in which sheets are fed in shingled formation. The invention is usable to particular advantage in sheet-fed printing presses, folders, die-cutters, folder-gluers, finishing machines and sheet inspection devices.

Other features which are considered as characteristic for the invention are set forth in the appended claims.

although the invention is illustrated and described herein as embodied in a method for feeding sheets to a printing technology machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
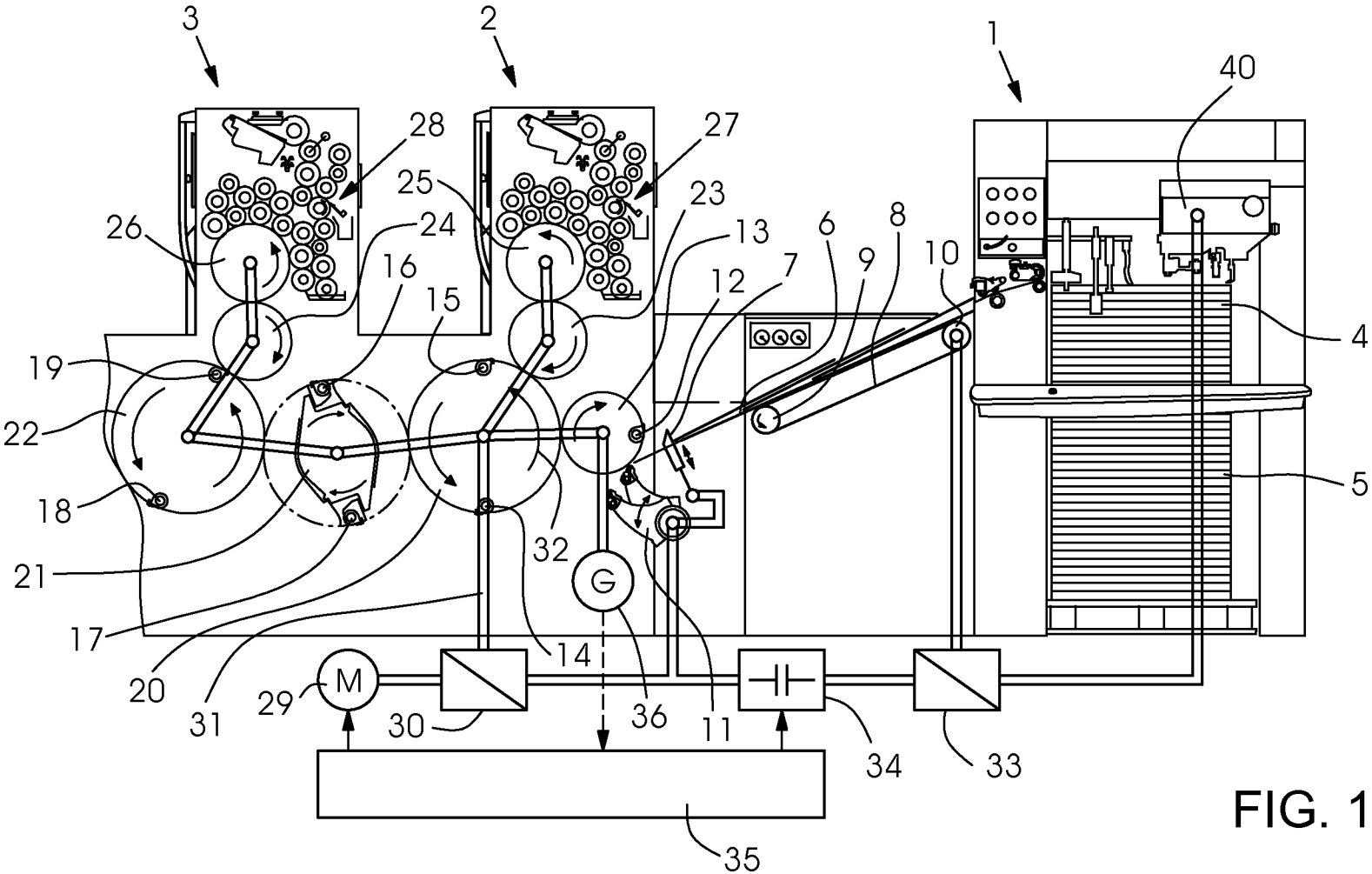
FIG. 1 is a fragmentary, diagrammatic, longitudinal-sectional view of a sheet-fed printing press having a main drive motor for printing units and a clutch for driving a feeder.

In known sheet-fed printing presses, one drive train is provided for the separation and conveying of sheets in a feeder and a separate drive train is provided for the conveying of the sheets through printing units. Referring now to the figures of the drawings in detail and first, particularly, to FIG. 1 thereof, there is seen a diagrammatic representation of a sheet-fed printing press, in which a feeder 1 and two printing units 2, 3 are shown. A stack 5 of sheets 4 is provided in the feeder 1. A suction head 40 separates the sheets 4 from the top side of the stack 5 and conveys them to a feed table 6. Among other elements, a conveying belt 8 guided by deflection rollers 9, 10 is provided to advance the sheets 4 against front lays 7. The sheets 4 are made available on the feed table 6 in shingled or overlapping formation before the printing operation starts.

During the printing operation, a swinging gripper 11 successively transfers individual sheets from the front lays 7 to grippers 12 of a feed drum 13. The feed drum 13 subsequently transfers the sheets 4 to grippers 14 to 19 of an impression cylinder 20, of a transfer drum 21, and of an impression cylinder 22. A respective color separation is printed onto the sheets 4 in a respective printing nip formed between a blanket cylinder 23, 24 and an impression cylinder 20, 22. Each color separation is created by inking a printing form on a plate cylinder 25, 26. The plate cylinders 25, 26 are in rolling contact with the blanket cylinders 23, 24 and with inking form rollers of an inking unit 27, 28.

A main drive motor 29 that applies a torque to a transmission 30 is provided to drive the printing press. The transmission 30 is formed of a plurality of transmission components such as a belt drive and gears. Double lines 31 in the illustration indicate a transmission of torque or power between the transmission components and between the rollers 9, 10, drums 13, 21 and cylinders 20, 22 to 26 that are connected to the transmission components. The rollers 9, 10, drums 13, 26 and cylinders 20, 22 to 26 revolve in synchronism in the direction indicated by the arrows 32.

A transmission 33 that is connectible to a drive train of the printing units 2, 3 through the use of a clutch 34 is used to drive the sheet-conveying elements in the feeder 1. Among other functions, the transmission 33 drives the suction head 40 and the conveying belt 8.

The motor 29 and the clutch 34 are connected to a control device 35. The axis of the feed drum 13 is connected to a rotary encoder 36 having a signal output which is connected to the control device 35. Signals at the output of the rotary encoder 36 indicate a circumferential speed of the feed drum 13 and/or a current printing speed v of the sheet-fed printing press.

Figure 3:
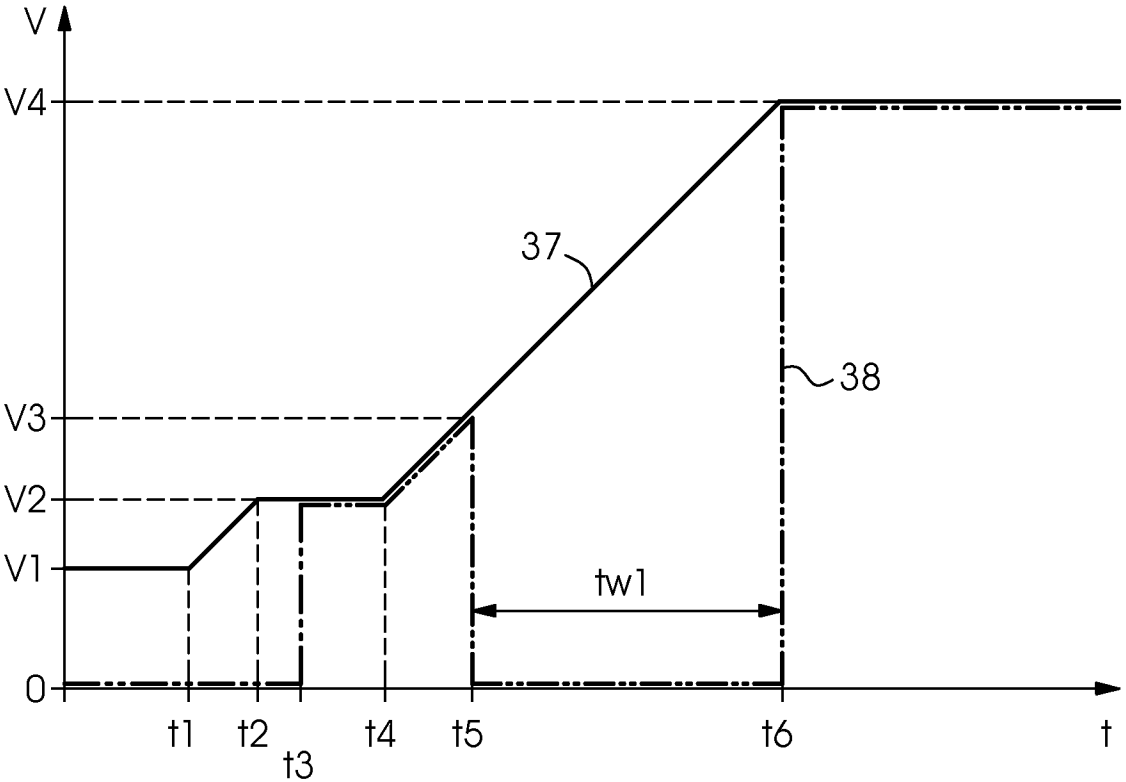
FIG. 3 is a speed/time diagram for a first variant of the invention.

A first variant of the method may be carried out on the sheet-fed printing press described above as follows:

Before the production run of a print job is started or to restart the sheet-fed printing press after an interruption of the printing operation, the sheets 4 are conveyed onto the feed table 6 in shingled formation. When the clutch 34 is open, the drums 13, 21 and cylinders 20, 22 that convey the sheets 4 rotate at an idling speed $v_1$ of 3000 rpm (revolutions per minute of the feed drum 13), for example. If, as shown in FIG. 3, a command to start up the sheet-fed printing press is issued at a time $t_1$, the speed v is increased until a start-up speed $v_2$, for example 5000 rpm, is reached at a time $t_2$. A curve 37 illustrates the speed progression of the sheets as they are conveyed through the printing units 2, 3. A dashed curve 38 illustrates the speed progression of the sheets 4 for elements of the feeder 1. At a time $t_3$, the clutch is actuated so that the transmission 33 causes sheets 4 to be conveyed onto the feed table. Due to the rigid coupling between the transmissions 30, 33, the speed for the loading of the feed table 6 follows the speed progression of the drums 13, 21 and cylinders 20, 22 that convey the sheets 4. At a time $t_4$, the acceleration of the printing units 2, 3 starts at a linear speed change. When the first sheet 4 rests against the front lays 7 at a time $t_5$, the feed table 6 is fully loaded, so that the clutch 34 is disengaged and the feeder 1 stops conveying sheets. The maximum speed $v_3$ during the loading of the feed table is low enough for the first sheet to arrive at the front lays 7 without fluttering corners.

Subsequently, with the feeder 1 at a standstill, the sheet-fed printing press is accelerated to a production speed $v_4$. After the drum 13, 21 and the cylinders 20, 22 rotate at production speed $v_4$ at a time $t_6$ and after a waiting period $t_{W1}=t_5-t_4$ has passed, the clutch 34 is actuated to restart the feeder 1. From the time $t_6$ on, individual sheets 4 are successively removed from the front lays 7 by the swinging grippers 11 and are fed to the first printing unit 2. For this purpose, a pawl on the swinging gripper 11 is closed. When the pawl is open, the swinging gripper 11 is prevented from transporting a sheet. The sheets are transported in the feeder 1 at the same speed $v_4$ as in the printing units 2, 3.

In the following description, reference numerals or symbols that have already been introduced indicate elements with equivalent functions or symbolic content.

Figure 4:
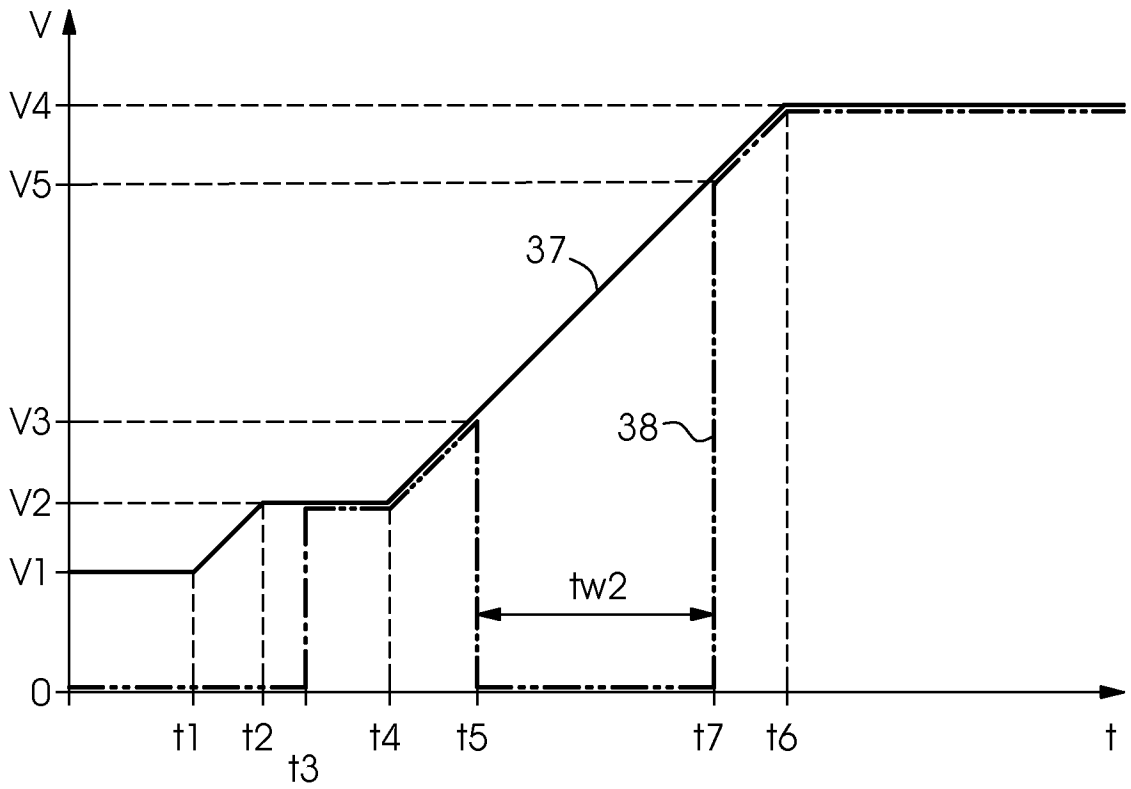
FIG. 4 is a speed/time diagram for a second variant of the invention.

FIG. 4 illustrates a second variant of the method. The difference between the variant shown in FIG. 4 and the variant shown in FIG. 3 is that in the one shown in FIG. 4, the waiting time $t_{W2}$ or rather standstill time $t_{W2}$ of the feeder 1 after the feed table 6 has been fully loaded is shortened. The clutch 34 is actuated at a time $t_7$ and an intermediate speed $v_5<v_4$. From the time $t_7$ on, sheets 4 are fed to the first printing unit 2. While the speed is increased from the intermediate speed $v_5$ to production speed $v_4$, sheets 4 are already being printed. The normal production run starts at a time $t_6$.

Figure 2:
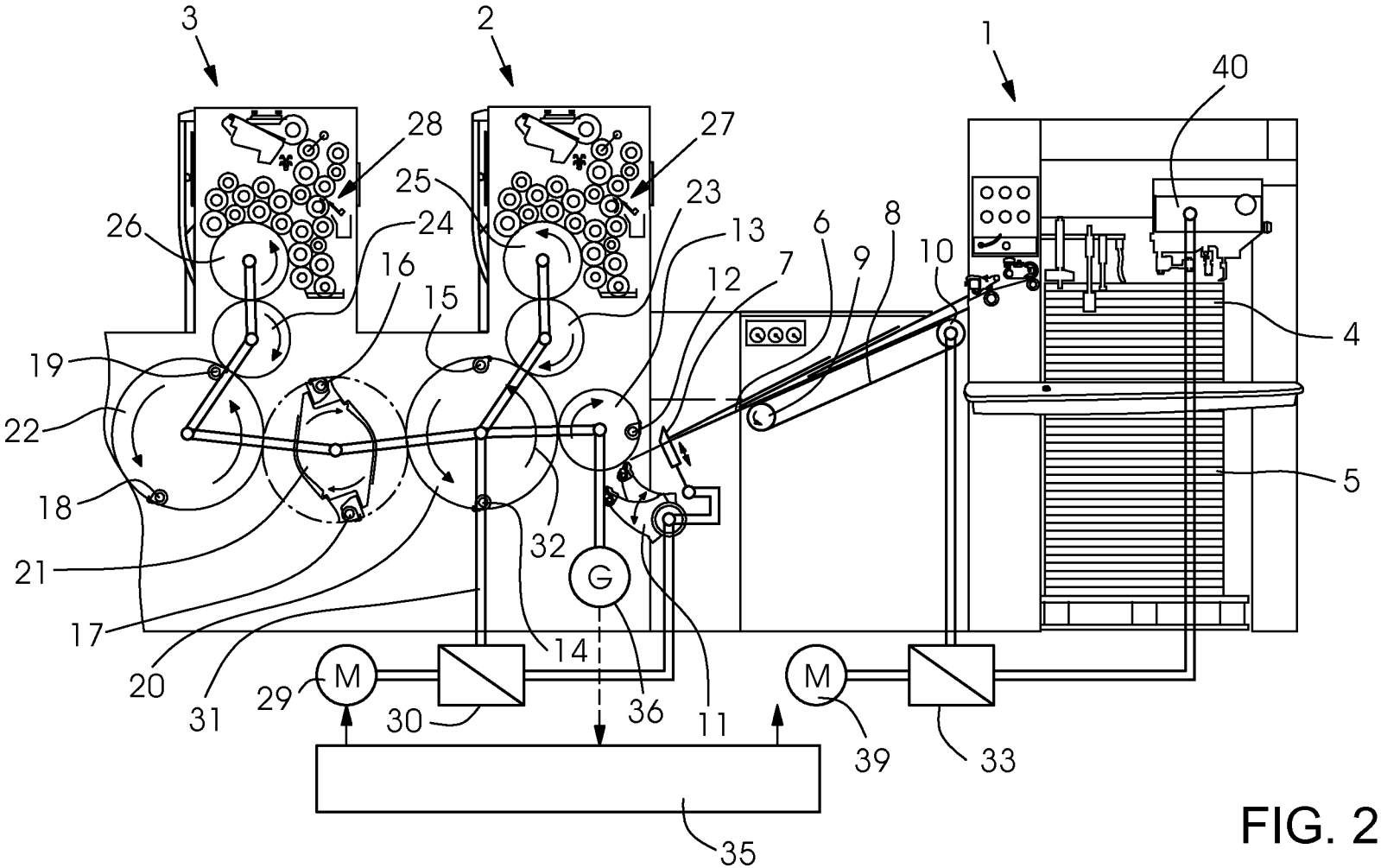
FIG. 2 is a longitudinal-sectional view of a sheet-fed printing press including a separate drive for a feeder and a main drive motor for the printing units.
Figure 5:
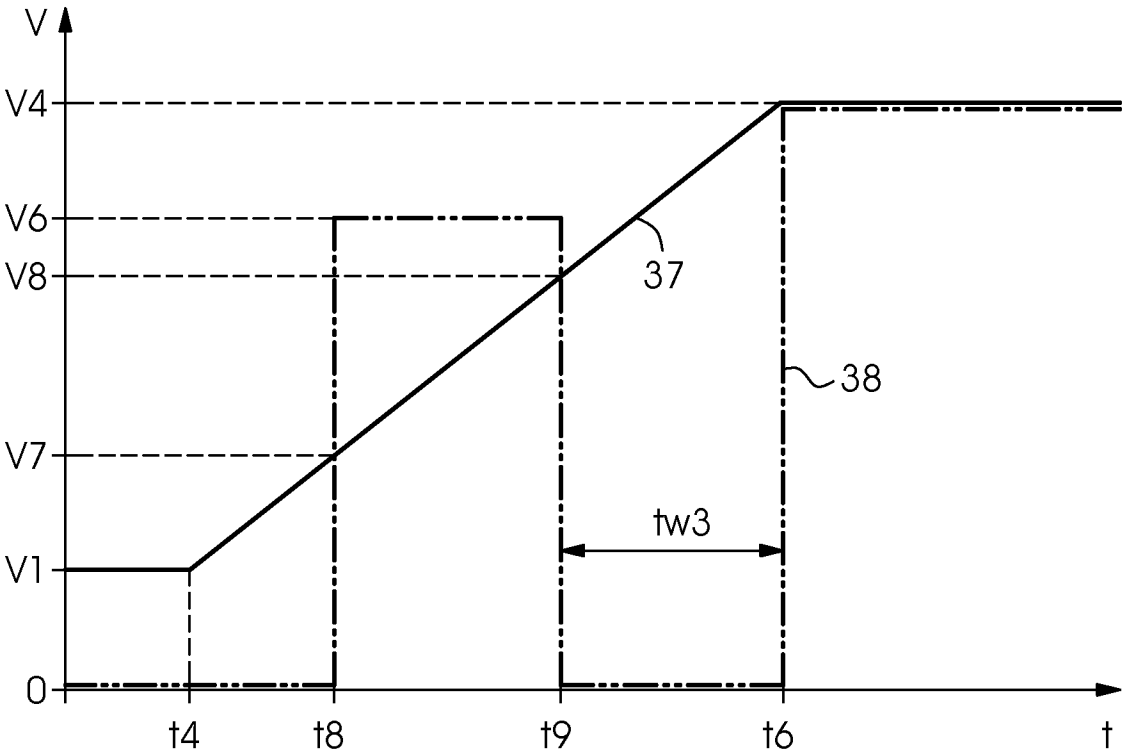
FIG. 5 is a speed/time diagram for a third variant of the invention.

In accordance with a variant shown in FIG. 2, the sheet-fed printing press is equipped with a separate drive motor 39 for the feeder 1. Thus, there is no mechanical driving connection between the transmissions 30, 33. Like the motor 29, the motor 39 is controlled by the control device 35. As a result of this driving configuration, the printing units 2, 3 and the feeder 1 may be run independently of each other at different speed profiles. This is shown in more detail in FIG. 5. While the drums 13, 21 and cylinders 20, 22 are accelerated form the start-up speed $v_2$ to production speed $v_4$, the feed table 6 is loaded. For this purpose, the motor 39 is actuated at a time $t_8$ to initiate the loading of the feed table 6 at speed $v_6$. This speed $v_6$ is higher than the respective current speed $v_7$ or $v_8$ of the drums 13, 21 and cylinders 20, 22 at times $t_8$ and $t_9$, respectively. When the first sheet 4 has reached the front lays 7, the loading of the feed table 6 is stopped at a time $t_9$. A waiting time $t_{W3}=t_6-t_9$ passes until the conveying of sheets in the feeder 1 is restarted. From the time $t_6$ on, the conveying of sheets in the feeder 1 and in the printing units 2, 3 are in synchronism and sheets 4 are being printed in the production run.

The speed at which sheets 4 are conveyed onto the feed table 6 may be adjusted as a function of the properties of the sheets. For instance, the speed may be set as a function of the thickness, stiffness, surface roughness, or friction coefficient of the sheets. For example, the speed at which thin sheets 4 are conveyed onto the feed table 6 may be lower than the speed at which thick sheets 4 are conveyed. If the drives for the feeder 1 and for the printing units 2, 3 are separately controllable, it is possible to convey sheets 4 of delicate paper onto the feed table 6 at a speed that is lower than the current start-up speed.

The invention claimed is:

1. A method for feeding sheets to a printing technology machine, the method comprising the following steps:

conveying the sheets in a conveying direction onto a feed table in shingled formation using a first drive;

conveying the sheets individually and successively from the feed table to a first processing station of the machine using a second drive; and accelerating the drives from a base speed to a production speed as follows:

conveying the sheets to the feed table before the second drive has reached the production speed;

stopping the first drive as soon as the sheets on the feed table assume a predefined position in the conveying direction and are at a predefined distance from each other; and then accelerating the first drive to the production speed after the processing station has reached the production speed.

2. The method according to claim 1, which further comprises setting a speed at which the sheets are conveyed onto the feed table as a function of sheet thickness.

3. The method according to claim 1, which further comprises conveying the sheets onto the feed table at a speed being lower than a current start-up speed.

4. The method according to claim 1, which further comprises providing mechanically decoupled transmissions with individually controllable motors as the drives.

5. The method according to claim 1, which further comprises providing couplable transmissions as the drives, and inputting a torque into one transmission by a motor.

* * * * *